US006269560B1

(12) United States Patent
Pratt

(10) Patent No.: US 6,269,560 B1
(45) Date of Patent: Aug. 7, 2001

(54) SWEEPING ASSEMBLY FOR EXCAVATING MACHINES AND THE LIKE

(75) Inventor: Samuel S. Pratt, Cumberland, MD (US)

(73) Assignee: Rockland Inc., Bedford, PA (US)

( * ) Notice: Subject to any disclaimer, the term of this patent is extended or adjusted under 35 U.S.C. 154(b) by 0 days.

(21) Appl. No.: 09/189,135

(22) Filed: Oct. 30, 1998

(51) Int. Cl.[7] ..... E02F 3/76; E02F 3/96

(52) U.S. Cl. ..... 37/408; 37/403; 37/409; 37/410; 37/901; 414/913; 403/111; 403/146; 15/23

(58) Field of Search ..... 37/403, 408, 409, 37/410, 901, 903; 414/912, 913; 403/111, 145, 146; 15/4, 22.1, 23, 105

(56) References Cited

U.S. PATENT DOCUMENTS

| | | | | |
|---|---|---|---|---|
| 25,460 | * | 9/1859 | Whitmore et al. | 403/111 |
| 1,100,029 | * | 6/1914 | Severns | 403/111 |
| 3,029,454 | * | 4/1962 | Short et al. | 403/111 |
| 3,922,745 | * | 12/1975 | Lehman | 15/87 |
| 4,615,637 | * | 10/1986 | Pelischek | 403/85 |
| 5,373,652 | * | 12/1994 | Olsson | 37/403 |
| 5,678,332 | * | 10/1997 | Hawkins | 37/403 |

FOREIGN PATENT DOCUMENTS

| | | | | |
|---|---|---|---|---|
| 88/ 03200 | * | 5/1988 | (EP) | 37/403 |
| 91/ 10016 | * | 7/1991 | (EP) | 37/403 |

* cited by examiner

*Primary Examiner*—H. Shackelford
*Assistant Examiner*—Gary S. Hartmann
(74) *Attorney, Agent, or Firm*—Lalos & Keegan

(57) ABSTRACT

A sweeping assembly for a machine having a handle generally comprising a first implement pivotally connectable to the handle; a strut assembly including a first arm member operatively connectable to the handle, a second arm member and a spring device operatively interconnecting the first and second members, and means for yieldably biasing the second arm member into a predetermined position relative to the first arm member; and a second implement mounted on the second arm member.

35 Claims, 3 Drawing Sheets

SWEEPING ASSEMBLY FOR EXCAVATING MACHINES AND THE LIKE

This invention relates to an improved sweeper apparatus mountable on the handle of a machine such as an excavating machine and the like. The invention further contemplates a sweeper apparatus mountable on the handle of an excavating machine equipped with a bucket which may be curled and uncurled, and which apparatus may be operated independently or in cooperation with such a bucket to sweep and remove materials lying on the ground or other surfaces.

BACKGROUND OF THE INVENTION

In certain excavating operations such as in the removal of overburden to uncover an underground pipeline, it often is desirable to remove loose soil on the pipeline or at the bottom of the cut. Usually such loose soil is removed by the use of a rotary brush mounted as an attachment to the handle of the excavating machine. In the prior art, such sweeper attachments generally have consisted of an arm member pivotally connected to the bucket pivot pin for pivotal movement in the same vertical plane as the bucket, a rotary brush mounted on the free end of the arm member, a motor supported on the arm member for rotating the brush and a latch for securing the arm member against the underside of the handle. The arm member is angularly displaceable between an upper, retracted inoperative position and a lower, extended operative position, relative to the handle of the machine. An example of such an attachment is illustrated and described in U.S. Pat. No. 5,373,652.

The attachment of rotary brush assemblies to the bucket pivot pin of excavation machines has several disadvantages. By connecting the sweeper attachment to the bucket pivot pin, the design of the connections of the bucket and the sweeper attachment to the machine handle becomes more complex, different pin sixes and configurations may be required and different types of connections are required to accommodate different bucket attachments of different machines. Furthermore, in the use of the type of attachment as described, the handle of the machine usually is set at an angle to the boom thereof to position the free end of the handle at a selected distance from the ground, the bucket mounted on the end of the handle is pivoted to a retracted position, a cylinder assembly operating the latch mechanism of the sweeper attachment is operated to release the brush so that it may swing down and have its bristles engage the ground or other surface to be swept, and then the machine is advanced along the desired sweeping path while the brush is rotated to sweep along the path of the brush. When it is desired to displace the arm member to the upper, retracted position, the bucket is pivoted to engage and pivot the arm member to the retracted position where it is engaged by latch mechanism. Such maneuvering can be cumbersome.

It thus has been found to be desirable to provide a sweeper attachment of the type described which will obviate the aforementioned problems in mounting the attachment to the handle of the machine and displacing the sweeper attachment between the in operative and operative position.

SUMMARY OF THE INVENTION

The present invention obviates the problems created by undue loads imposed on prior art sweeping assemblies of the type described by providing an improved apparatus for an excavating machine and the like equipped with an operating handle, generally comprising a first arm member pivotally connectable to the underside of the handle of the machine, a second arm member operatively connected to the first arm member, a rotary brush operatively connected to the second arm member including means for rotating the brush, means operatively connected to the first arm member and connectable to the handle for displacing the first arm member relative to the handle, and means operatively interconnecting the first and second arm members yieldably biasing the second arm member into a given disposition relative to the first arm member. The second arm member may be pivotally connected to the first arm member and the yieldable biasing means may consist of a spring operatively interconnecting the first and second members to bias the second arm member into a given disposition relative to the first arm member. Preferably, the means operating the rotary brush consist of a hydraulic motor supported on the second arm member and the means for angularly displacing the first arm member relative to the handle consist of a hydraulically actuated cylinder assembly.

Furthermore, in the use of the type of attachment as described, the handle of the machine usually is set at an angle to the boom thereof to position the free end of the handle at a selected distance from the ground, the bucket mounted on the end of the handle is pivoted to a retracted position, the cylinder assembly of the sweeper attachment is operated to position the brush so that its bristles engage the ground or other surface to be swept and then the machine is advanced along the desired sweeping path while the brush is rotated to sweep along the path of the brush. If the handle is accidentally positioned too close to the ground or other surface to be swept, or may oscillate vertically during operation due to the advancing motion of the machine, or the brush encounters obstacles in its sweeping path, undue loads may be imposed on the brush and transmitted to the arm or cylinder assembly of the attachment which may adversely affect the sweeping operation of the brush or, if sufficiently severe, may cause damage to the brush, the brush motor or cylinder assembly of the attachment.

It thus has been found desirable to provide a sweeper attachment of the type described which will obviate the aforementioned problems in mounting the attachment to the handle of the machine and incurring undue loads on the attachment during a sweeping operation.

SUMMARY OF THE INVENTION

The present invention's obviates the aforementioned problems by providing an improved apparatus for an excavating machine and the like provided with an operating handle, generally comprising a first arm member pivotally connectable to the underside of the handle of the machine, a second arm member operatively connected to the first arm member, a rotary brush operatively connected to the second arm member including means for rotating the brush, means operatively connected to the first arm member and connectable to the handle for displacing the first arm member relative to the handle, and means operatively interconnecting the first and second arm members yieldably biasing the second arm member into a given disposition relative to the first arm member.

The second arm member may be pivotally connected to the first arm member and the yieldable biasing means may consist of a spring operatively interconnecting the first and second members to bias the second arm member into a given disposition relative to the first arm member. Preferably, the means operating the rotary brush consists of a hydraulic motor supported on the second arm member and the means for angularly displacing the first arm member relative to the handle consists of a hydraulically actuated cylinder assembly.

DESCRIPTION OF THE PREFERRED EMBODIMENTS OF THE INVENTION

Figures 1, 1A, 1B:
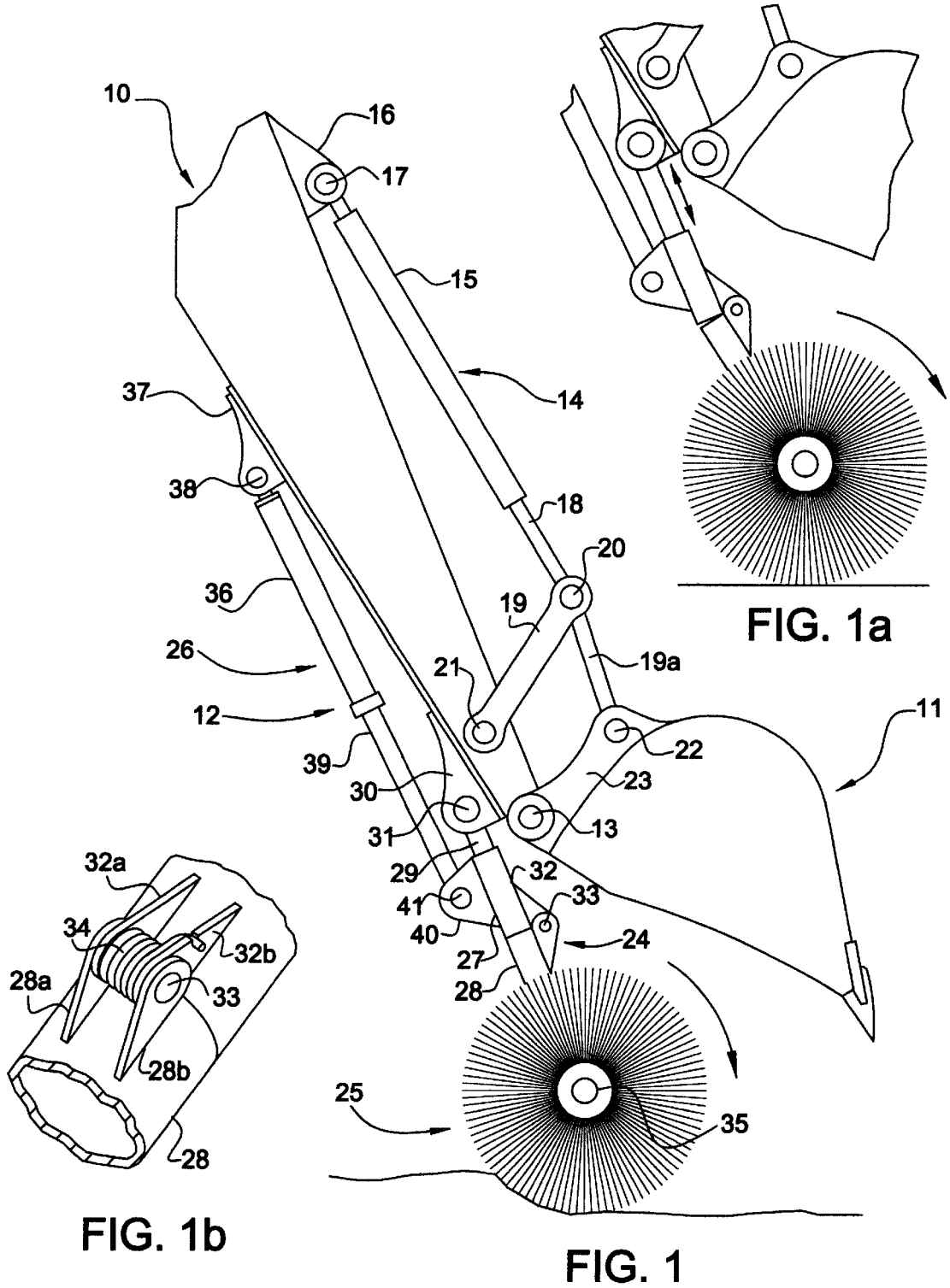
FIG. 1 is a side elevational view of a portion of the front-end assembly of an excavating machine including a sweeping assembly embodying the present invention.
FIG. 1*a* is view similar to the view shown in FIG. 1, illustrating the sweeping assembly in a condition having an undue load imposed thereon.
FIG. 1*b* is an enlarged, perspective view of portions of the arm members of the assembly shown in FIGS. 1 and 1*a* and the connection therebetween.
Figure 2:
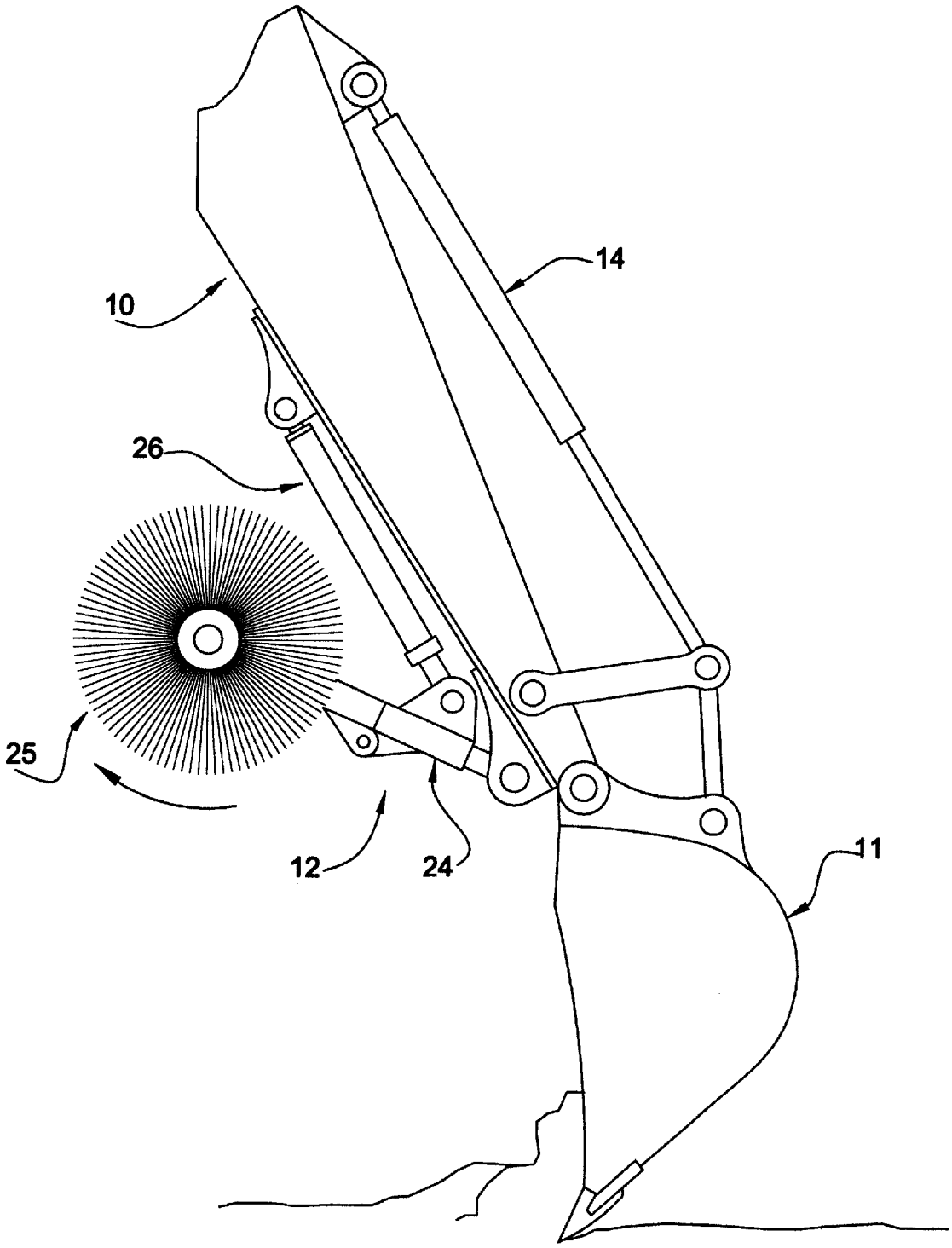
FIG. 2 is view similar to the view shown in FIG. 1, illustrating the bucket thereof in an operative mode performing an excavating operation and the sweeper apparatus in a retracted, inoperative position.
Figure 3:
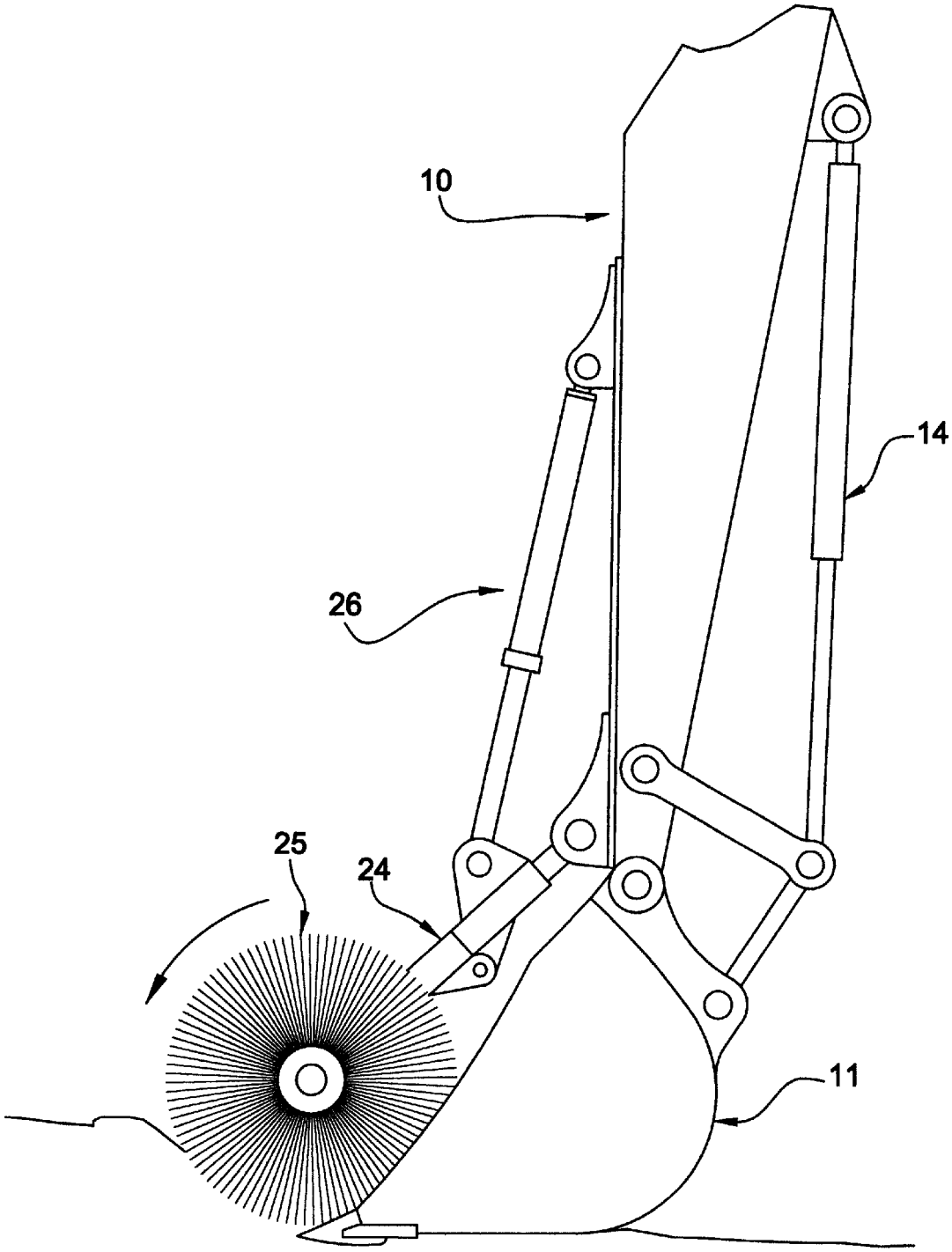
FIG. 3 is a side elevational view similar to the views shown in FIGS. 1 and 2, illustrating the bucket in a position cooperating with the sweeper apparatus and the sweeper apparatus in an extended, operative position for sweeping materials into the bucket.

Referring to the drawings, there is partially illustrated the front end assembly of an excavating machine which includes a handle 10 which is pivotally connected to the boom of the machine which in turn is pivotally connected to the platform or support frame of the machine. Typically, the platform or support frame of the machine is mounted on a mobile base of the machine for swing movement about a vertical axis, the body is angularly displaceable relative to the platform or support frame of the machine about a horizontal axis and handle 10 is angularly displaceable relative to the boom about a horizontally axis. Hydraulic cylinder assemblies are provided for angularly displacing the boom relative to the platform or support frame of the machine and angularly displacing the handle relative to the boom. A bucket 11 is pivotally connected to a free end of handle 10 and a sweeper apparatus 12 is mounted to the underside of handle 10. The bucket may be operated independently of the sweeper apparatus to perform conventional excavating operations, the sweeper apparatus may be operated independently of the bucket to perform ground sweeping operations or the sweeper apparatus may be operated in cooperation with the bucket to sweep material into the bucket. The bucket may be positioned in an uncurled position as shown in a FIG. 1, a curled position or an intermediate position cooperating with the sweeper apparatus as shown in FIG. 3. The sweeper apparatus may be positioned in a frilly extended, operable position as shown in FIG. 1, a filly retracted, inoperative position as shown in FIG. 2 and an intermediate position cooperating with the bucket as shown in FIG. 3.

Bucket 11 is pivotally mounted on the free end of handle 10 by means of a connecting pin 13 so that it opens toward the machine in the conventional manner. The bucket is pivoted about a horizontal axis of pin 13 by means of a hydraulic cylinder assembly 14. The assembly consists of a cylinder member 15 connected at its base end to a bracket 16 mounted on the upper side of handle 10 by means of a connecting pin 17, and a rod member 18 connected to a support link 19 by means of a connecting pin 20. The support link is pivotally connected to handle 10 by means of a connecting pin 21, and the motion of the rod member is transmitted to the bucket by means of a connecting link 19*a* pivotally connected to pin 20 and a connecting pin 22 mounted on brackets 23 provided on an upper wall portion of the bucket. It will be appreciated that by operating cylinder assembly 14, the bucket may be pivoted between uncurled and curled positions for performing conventional excavating operations, may be pivoted totally uncurled, inoperative position and may be pivoted and positioned to an intermediate position for cooperation with the sweeper apparatus.

The sweeper apparatus consists of a strut assembly 24 pivotally connected to handle 10, a rotary brush 25 mounted on the strut assembly and a cylinder assembly 26 operatively interconnecting the handle and the strut assembly. The strut assembly generally includes a first arm member 27 and a second arm member 28. Arm member 27 includes a base section 29 pivotally connected to a bracket 30 rigidly secured to the underside of handle 10 by means of a connecting pin 31 and an extendable section 32 telescopically connected to base section 29. Arm member 28 is pivotally connected to extension arm section 32 by means of a connecting pin 33. As best seen in FIG. 1b, connecting pin 33 pivotally connects a pair of brackets 32*a* and 32*b* rigidly secured to extension arm section 32 to a pair brackets 28*a* and 28*b* rigidly secured to arm member 28. A heavy duty coil spring 34 mounted on connecting pin 33 and having ends thereof anchored on brackets 28*a* and 32*b* functions to yieldably bias arm member 28 into longitudinal alignment with arm member 27 as shown in FIG. 1, and permit the angular displacement of arm member 28 relative to arm member 27 as shown in FIG. 1*a* as when an undue load is applied on the strut assembly.

Rotary brush 25 is rotatably mounted on a shaft 35 supported on arm member 28. Also supported on arm member 28 is hydraulic motor for rotating brush 25. Fluid lines conveying fluid to and from the hydraulic motor are attached to the strut assembly, handle and boom of the machine and connected to a suitable pump mounted on the support frame of the machine.

Cylinder assembly 26 includes a cylinder member 36 pivotally connected to a bracket 37 rigidly secured to the underside of the handle at a point spaced from bracket 30, by means of a connecting pin 38, and a rod member 39 connected to a bracket 40 rigidly mounted on extension section 32 of arm member 27 by means of a connecting pin 41. The cylinder member is provided with conventional fluid lines which also are attached to the handle and boom members and connected to a fluid pump on the support platform of the machine. It will be appreciated that by operating cylinder assembly 26, the sweeper apparatus may be positioned in a fully extended operative position as shown in FIGS. 1 and 1*a*, a filly retracted, inoperative position as shown in FIG. 2 or a partially extended, operative position as shown in FIG. 3. In either the fully extended or partially extended, operable position of the sweeper apparatus, the spring shown in FIG. in 1*b* will function to yieldably bias arm member 28 into longitudinal alignment with arm member 27 and permit an angular displacement of arm member 28 relative to arm member 27 whenever an undue load is imposed on the strut assembly.

The axes of connecting pin 13 of bucket 11, connecting pin 31 of strut assembly 24 and shaft 35 are substantially parallel and horizontal so that the pivotal movements of bucket 11 and strut assembly 24 will lie in a common, vertical plane. The center line of strut assembly 24 lies in a vertical plane passing through the center of bucket 11, rotary brush 25 is aligned with the opening in the bucket and the transverse dimension of the rotary brush may be smaller, the same or larger than the transverse dimension of the bucket opening the ground engaging brush along the selected sweeping path. Cylinder assembly 26 further may be operated to displace extendible section 32 relative to base section 29 of arm member 27 to extend the length of the strut assembly. To operate in the sweeping and the material removal mode, cylinder assembly 14 is operated to position the bucket in a partially uncurled position and cylinder assembly 26 is operated to position the sweeper apparatus in a partially extended position disposed adjacent to the opening in the bucket, as shown in FIG. 3, and various controls on the machine are operated to displace the handle of the machine and/or propel the machine in a reverse direction to cause material being engaged and swept by the rotary brush to be received within the bucket.

Although the embodiment as described utilizes a coil spring interconnecting the inner and outer arm members of the strut assembly and having an axis disposed substantially transversely relative to the length of the inner arm member as a means for allowing the displacement of the outer arm member relative to the inner arm member when an undue load is imposed on the strut assembly, for the purpose of preventing damage to the strut assembly, it is to be understood that other means may be used to cause the strut assembly to yield upon the imposition undue loads thereon. As an example, in lieu of a heavy duty coil spring interconnecting the inner and outer arm members and having an axis disposed transversely relative to the length of the inner arm member, a heavy duty coil spring interconnecting the inner and outer arm members may interconnect the members with the axis of the spring in its relaxed condition being disposed in longitudinal alignment with the inner arm member. In such an embodiment, the inner and outer arm members may be formed as tubular members and the spring may be inserted into opposed ends of the arm members with each end thereof secured to an arm member. In such an arrangement, the ends of the arm members would be spaced from each other and interconnected by a coil spring having sufficient rigidity to maintain the outer arm member aligned longitudinally with the inner arm member during normal sweeping operations with a suitable force being imposed on the strut member, capable of deflecting upon the imposition of an undue load on the strut assembly and further having a sufficient spring rate to cause the spring to return to its normal relaxed condition and thus bias the outer arm member into longitudinal alignment with the inner arm member. In addition, the inner and outer members of the strut assembly may be interconnected in the manner of a conventional shock absorber which would allow the outer arm member to displace relative to the inner arm member along a common axis of the members. Still other connections between the arm members of the strut assembly are contemplated within the scope of the present invention in which the outer arm member is allowed to displace relative to the inner arm member upon the imposition of an undue load on the strut assembly to prevent damage to the assembly.

From the foregoing detailed description it will be evident that there are a number of changes, adaptations, an modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A sweeping assembly for a machine having a handle comprising:

an implement pivotally connectable to said handle;

a first arm member pivotally connectable to said handle;

a second arm member pivotally connectable to said first arm member;

a rotary brush operatively connectable to said second arm member including means for driving said brush;

means operatively connectable between said handle and said first arm member for pivoting said first arm member relative to said handle; and means operatively interconnecting said first and second arm members for yieldably biasing said second arm member into a given disposition relative to said first arm member.

2. A sweeping assembly according to claim 1 wherein said implement and said first arm member are pivotal in a common plane when said implement and said first arm member are connected to said handle.

3. A sweeping assembly according to claim 1 wherein said implement comprises a bucket having a material receiving opening maneuverable to open towards said brush when said bucket and said first arm member are mounted on said handle.

4. A sweeping assembly according to claim 3 wherein said bucket and said first arm member are pivotal in a common plane to permit material swept by said brush to be received within said bucket.

5. A sweeping assembly according to claim 1 wherein said implement and said first arm member are pivotal and said brush is rotatable about substantially parallel axes when said implement and said first arm member are pivotally connected to said handle.

6. A sweeping assembly according to claim 1 wherein said implement is pivotally connectable to a free end of said handle and said first arm member is pivotally connectable to an underside of said handle adjacent the pivotal connection of said implement to said handle.

7. A sweeping assembly according to claim 1 wherein said biasing means is operable to yieldably bias said second arm member into longitudinal alignment with said first arm member.

8. A sweeping assembly according to claim 1 wherein said yieldable biasing means comprises a spring.

9. A sweeping assembly according to claim 8 wherein said first and second arm members are pivotally connected together by means of a connecting pin and said biasing means includes a coil spring mounted on said connecting pin, having a plurality of ends thereof secured to said arm members for biasing said arm members in longitudinal alignment.

10. A sweeping apparatus according to claim 1 wherein said first arm member includes a base section pivotally connectable to said handle and an extendible section pivotally connected to said second arm member.

11. A sweeping assembly according to claim 10 wherein said base and extendible sections are telescopically connected.

12. A sweeping assembly according to claim 10 wherein said yieldable biasing means comprises a spring.

13. A sweeping assembly according to claim 10 wherein said extendible section of said first arm member and said second arm member are pivotally connected together by means of a connecting pin and said biasing means includes a coil spring mounted on said connecting pin, having a plurality of ends thereof secured to said extendible section of said first arm member and to said second arm member for biasing said arm members in longitudinal alignment.

14. A sweeping assembly according to claim 1 wherein said means for rotating said rotary brush comprises a hydraulic motor supported on said second arm member.

15. A sweeping assembly according to claim 1 wherein said means for pivoting said first arm member relative to said handle comprises a hydraulically actuated cylinder assembly.

16. A sweeping assembly for a machine having a handle comprising;

a first implement pivotally connectable to said handle;

a strut assembly including a first arm member operatively connectable to said handle, a second arm member and means operatively interconnecting said first and second arm members, having means for yieldably biasing said second arm member into a predetermined position relative to said first arm member; and a second implement mounted on said second arm member.

17. A sweeping assembly according to claim 16 wherein said second implement comprises a motor driven rotary brush.

18. A sweeping assembly according to claim 16 wherein said first implement comprises an excavating bucket.

19. A sweeping assembly according to claim 16 including means operatively inter-connectable between said first arm member and said handle for selectively displacing said strut assembly between a retracted, inoperative position and an extended, operative position.

20. A sweeping assembly according to claim 16 wherein said implements are operable independently of or in cooperation with each other.

21. A sweeper apparatus for a machine having a handle comprising; first arm member pivotally connectable to said handle;

a second arm member pivotally connected to said first arm member;

a rotary brush operatively connected to said second arm member including means for driving said brush;

means operatively interconnectable between said handle and said first arm member for pivoting said first arm member relative to said handle; and means operatively interconnecting said first and second arm members for yieldably biasing said second arm member into a given disposition relative to said first arm member.

22. A sweeper apparatus according to claim 21 wherein said yieldable biasing means comprises a spring.

23. A sweeper apparatus according to claim 21 wherein said biasing means is operable to yieldably bias said second arm member into longitudinal alignment with said first arm member.

24. A sweeper apparatus according to claim 23 wherein said first and second arm members are pivotally connected together by means of a connecting pin and said biasing means includes a coil spring mounted on said connecting pin, having a plurality of ends thereof secured to said arm members for biasing said arm members into longitudinal alignment.

25. A sweeper apparatus according to claim 21 wherein said first arm member includes a base section pivotally connectable to said handle and an extendible section pivotally connected to second arm member.

26. A sweeper apparatus according to claim 25 wherein said base and extendible sections are telescopically connected.

27. A sweeper apparatus according to claim 21 wherein said yieldable biasing means comprises a spring.

28. A sweeper apparatus according to claim 25 wherein said extendible section of said first arm member and second arm member are pivotally connected together by means of a connecting pin and said biasing means including a coil spring mounted on said connecting pin, having a plurality of ends thereof secured to said extendible section of said first arm member and to said second arm member for biasing said arm members into longitudinal alignment.

29. A sweeper apparatus according to claim 21 wherein said means for rotating said rotary brush comprises a hydraulic motor supported on said second arm member.

30. A sweeper apparatus according to claim 21 wherein said means for pivoting said first arm member relative said handle comprises a hydraulically actuated cylinder assembly.

31. A sweeper apparatus for a machine having a handle comprising:

a strut assembly including a first arm member operatively connectable to said handle, a second arm member and means operatively interconnecting said first and second arm members, having means for yieldably biasing said second arm member into a predetermined position relative to said first arm member; and an implement mounted on said second arm member.

32. A sweeper apparatus according to claim 31 wherein said implement comprises a motor driven rotary brush.

33. A sweeper apparatus according to claim 31 wherein said implement is cooperable with a second implement mounted on said handle.

34. A sweeper apparatus according to claim 31 including means operatively interconnecting said strut assembly and said handle for selectively displacing said strut assembly between a retracted, inoperative position and an extended, operative position.

35. A sweeper apparatus according to claim 31 wherein said implement is operable independently of or in cooperation with a second implement mounted on said handle.

* * * * *

UNITED STATES PATENT AND TRADEMARK OFFICE

CERTIFICATE OF CORRECTION

PATENT NO. : 6,269,560 B1
DATED : August 7, 2001
INVENTOR(S) : Samuel S. Pratt

It is certified that error appears in the above-identified patent and that said Letters Patent is hereby corrected as shown below:

Title page,
Item [57], ABSTRACT,
Line 5, delete “a spring device” and insert -- a hinge --;
Line 6, delete “means” and insert -- a spring device --.

Column 2,
Delete lines 42 through 67.

Signed and Sealed this

Second Day of July, 2002

*Attest:*

*Attesting Officer*

JAMES E. ROGAN
*Director of the United States Patent and Trademark Office*